US010844522B2

(12) United States Patent
Widner et al.

(10) Patent No.: US 10,844,522 B2
(45) Date of Patent: Nov. 24, 2020

(54) METHOD FOR CLEANING A SPINNING ROTOR OF OPEN-END SPINNING MACHINE HAVING AT LEAST ONE SPINNING DEVICE, AND A CLEANING DEVICE FOR CLEANING A SPINNING ROTOR

(71) Applicant: MASCHINENFABRIK RIETER AG, Winterthur (CH)

(72) Inventors: Harald Widner, Ingolstadt (DE); Frank Baier, Hohenwart (DE); Sebastian Fritz, Dietfurt (DE)

(73) Assignee: Maschinenfabrik Rieter AG, Winterthur (CH)

( * ) Notice: Subject to any disclaimer, the term of this patent is extended or adjusted under 35 U.S.C. 154(b) by 160 days.

(21) Appl. No.: 16/118,589

(22) Filed: Aug. 31, 2018

(65) Prior Publication Data

US 2019/0071798 A1 Mar. 7, 2019

(30) Foreign Application Priority Data

Sep. 1, 2017 (DE) ..... 10 2017 120 199

(51) Int. Cl.
*D01H 4/24* (2006.01)
*D01H 4/48* (2006.01)

(52) U.S. Cl.
CPC ..... *D01H 4/24* (2013.01); *D01H 4/48* (2013.01)

(58) Field of Classification Search
CPC ..... D01H 4/24
See application file for complete search history.

(56) References Cited

U.S. PATENT DOCUMENTS 4,480,433 A * 11/1984 Ryer, II ..... D01H 4/24 15/21.1
5,182,903 A 2/1993 Stahlecker
(Continued)

FOREIGN PATENT DOCUMENTS

DE 41 07 403 A1 9/1992
DE 41 31 684 A1 3/1993
(Continued)

OTHER PUBLICATIONS

Machine Translation of DE 102004016547, retrieved Apr. 2, 2020.*
EP Search Report, dated Feb. 12, 2019.
German Patent Office Search Report, dated May 23, 2018.

*Primary Examiner* — Shaun R Hurley
(74) *Attorney, Agent, or Firm* — Dority & Manning, P.A.

(57) ABSTRACT

An open-end spinning machine and control method are provided for cleaning a spinning rotor of a spinning device in which at least one cleaning measure is carried out on the spinning rotor with the aid of a pneumatic or a mechanical cleaning device. With a control unit associated with the open-end spinning machine, settings are specified for the cleaning device to carry out the cleaning measure, wherein the settings are empirically determined based on one or more operational parameters of the spinning rotor. Operational parameters are stored in a memory bank associated with the control unit. The specific settings for carrying out the cleaning measure for a particular spinning rotor are automatically determined by reference to the operational parameters stored in the memory bank that are applicable to the particular spinning rotor.

13 Claims, 7 Drawing Sheets

(56) References Cited

U.S. PATENT DOCUMENTS

| | | | | |
|---|---|---|---|---|
| 5,557,916 | A | 9/1996 | Messmer et al. | |
| 5,666,798 | A * | 9/1997 | Novotny | D01H 4/24 57/301 |
| 6,321,521 | B1 * | 11/2001 | Burchert | D01H 4/24 57/263 |
| 7,082,746 | B2 | 8/2006 | Brandl et al. | |
| 9,873,959 | B2 | 1/2018 | Stephan | |
| 2005/0044841 | A1 * | 3/2005 | Brandl | D01H 4/48 57/263 |
| 2017/0175299 | A1 * | 6/2017 | Stephan | D01H 4/50 |

FOREIGN PATENT DOCUMENTS

| | | | |
|---|---|---|---|
| DE | 44 31 810 | A1 | 3/1996 |
| DE | 102 31 484 | A1 | 9/2003 |
| DE | 103 27 370 | A1 | 1/2005 |
| DE | 10 2004 016 547 | A1 | 10/2005 |
| DE | 10 2004 029 988 | A1 | 1/2006 |
| DE | 10 2005 025 786 | A1 | 12/2006 |
| DE | 10 2015 122 391 | A1 | 6/2017 |

* cited by examiner

METHOD FOR CLEANING A SPINNING ROTOR OF OPEN-END SPINNING MACHINE HAVING AT LEAST ONE SPINNING DEVICE, AND A CLEANING DEVICE FOR CLEANING A SPINNING ROTOR

FIELD OF THE INVENTION

The present invention relates to a method for cleaning a spinning rotor of a spinning device of an open-end spinning machine, in the case of which at least one cleaning measure is carried out on the spinning rotor with the aid of a cleaning device. In doing so, settings utilized for carrying out the cleaning measure are specified by a control unit of the open-end spinning machine. Moreover, the invention relates to an open-end spinning machine having at least one spinning device including a spinning rotor, a cleaning device, and a control unit.

BACKGROUND

Open-end spinning machines comprising a cleaning device for cleaning a spinning rotor have become known in multiple embodiments in the state of the art. For example, DE 102 31 484 A1 describes cleaning the open-end spinning devices of a rotor spinning machine with the aid of a movable maintenance unit. For this purpose, the maintenance unit has a cleaning device including a cleaning head comprising mechanical cleaning elements such as scrapers or compressed air nozzles. In order to clean the spinning rotor, the maintenance unit is positioned in front of the relevant spinning device, opens the spinning device, advances the cleaning head toward the spinning rotor, and cleans the spinning rotor.

DE 41 31 684 A1 describes carrying out the cleaning of the spinning rotor with the aid of a cleaning device situated on the spinning device. In this case, one or multiple cleaning bores is/are provided in a cover element of the spinning device, through which compressed air can be blown into the spinning rotor. The compressed air is fed to the spinning device by the spinning machine, but the appropriate valves are actuated with the aid of a movable maintenance unit.

DE 10 2005 025 786 A1 also describes a spinning machine comprising cleaning units at each workstation, which can be mechanically designed as scrapers or as brushes, or which can be pneumatically designed including blowing nozzles for the outflow of compressed air. The rotor cleaning can take place, in this case, independently of a maintenance unit, since the spinning unit comprises all means for carrying this out automatically.

An aspect shared by the aforementioned spinning machines and cleaning devices is that the cleaning always takes place according to a determined scheme, i.e., using fixedly predefined values. Values of this type are understood to be, for example, a duration of the cleaning or a rotational speed of the spinning rotor during the cleaning. The values are set once during the start-up of the spinning machine or the spinning device and, subsequently, the cleaning is always carried out using the implemented settings. The settings which are suitable for the particular application are entered by an operator, on the basis of empirical values, into a control unit of the open-end spinning machine. If necessary, the operator must make several attempts to find suitable settings in each case. Nevertheless, it does happen that a sufficient cleaning of the spinning rotor cannot be achieved, which can cause problems in the subsequent piecing and adversely affects the quality of the piecing.

SUMMARY OF THE INVENTION

A problem addressed by the present invention is that of creating a method for cleaning a spinning rotor and creating an open-end spinning machine, with the aid of which the cleaning results can be improved. Additional objects and advantages of the invention will be set forth in part in the following description, or may be obvious from the description, or may be learned through practice of the invention.

The problems are solved with the aid of the features of the invention set forth herein.

In a method for cleaning a spinning rotor of a spinning device of an open-end spinning machine, at least one cleaning measure is carried out on the spinning rotor with the aid of a pneumatic and/or a mechanical cleaning device. In doing so, settings utilized for carrying out the at least one cleaning measure are specified by a control unit of the open-end spinning machine. It is now provided that various parameters are stored in a memory bank. Moreover, previously empirically determined settings for carrying out the cleaning measure, which are suitable for the particular parameters, and/or rules for determining settings which are suitable for the particular parameters are stored. The settings for carrying out the at least one cleaning measure are automatically determined by the control unit with the aid of the memory bank depending on presently given parameters on the spinning device.

Preferably, the computed settings are automatically set by the control unit. It is also possible, however, that the determined settings are initially displayed to an operator who can then confirm these settings or can correct these settings, even after a certain period of operation, if necessary. If determined settings are corrected, these can also be added to the memory bank, and so the determination of suitable settings is successively improved.

In the case of an open-end spinning machine comprising at least one spinning device including a spinning rotor, comprising at least one cleaning device, and comprising a control unit, the control unit is therefore designed for carrying out the method.

The parameters stored in the memory bank can advantageously include operating parameters of the spinning device such as a type of the spinning rotor, the material type of the presently spun yarn, or the type of a presently utilized conduit plate adapter. The parameters can also include cleaning parameters of the cleaning measure, such as a certain cleaning type or cleaning measure, a rotor speed, a direction of rotation of the rotor, and a cleaning duration during the cleaning measure. On the basis of these, the control unit then determines further settings for carrying out the cleaning measure, for example, an opening angle of a cover element or the implementation of repeat cycles, if necessary by utilizing further parameters presently given on the spinning device.

Moreover, rules for determination on the basis of decision trees, rules for linking multiple parameters, and calculation formulas for calculating suitable settings can be stored as rules for determining suitable settings of the cleaning device. It is also possible, however, to store parameters and settings assigned to these parameters in the form of a matrix.

With respect to the settings for carrying out the cleaning measure, it is advantageous when these parameters include at least a duration of the cleaning and/or a rotational speed and/or a direction of rotation of the spinning rotor. Moreover, the settings can also include a number of repetitions of the cleaning measures, a reversing drive of the spinning rotor during the cleaning measures and/or the type of cleaning measure, for example, the cleaning of the fiber slip wall or the edge of the spinning rotor, or suction for waste removal. It is also conceivable to carry out multiple cleaning measures in succession in the case of difficult applications.

In order to drive the spinning rotor during the cleaning measure, it is advantageous when the spinning device comprises a single drive for driving the spinning rotor. This makes it possible to adapt the rotational speed of the spinning rotor during the cleaning and to drive the spinning rotor in a reversing manner during the cleaning.

According to one advantageous embodiment of the invention, the spinning device comprises a drive for opening a cover element of the spinning device, which is displaceable between an open position and a closed position. Preferably, the cover element can be additionally brought into at least one intermediate position having a predefinable opening angle. As a result, the spinning device can be brought into the closed position during the spinning operation and, in order to clean the spinning rotor, can be brought into the open position or into the at least one intermediate position having the predefinable opening angle.

In the method, a cover element of the spinning device is therefore at least partially opened in order to carry out the cleaning measure. Preferably, the spinning device comprises, for this purpose, a spinning device-specific, preferably pneumatic cleaning device. The opening of the cover element by a certain opening angle can take place, in this case, in order to increase the gap between the spinning rotor and a shoulder of the cover element or the conduit plate adapter for suction for waste removal or even to be able to clean certain areas of the spinning rotor with the aid of the pneumatic cleaning device.

According to one particularly advantageous embodiment of the invention, the parameters include at least the type of conduit plate adapter and the type of spinning rotor. The settings of the cleaning device include at least an opening angle of the cover element of the spinning device. If the cleaning element of the cleaning device, in particular a cleaning bore, is situated in the cover element or within the conduit plate adapter, it is possible to clean various types of spinning rotors even including various conduit plate adapters with the aid of a single cleaning bore and to align the cleaning bore with the area of the spinning rotor to be cleaned, in particular, the rotor groove.

If the cleaning measure includes several cleaning steps, it is also advantageous when a separate opening angle of the cover element of the spinning device is assigned to each of the cleaning steps. For example, it is possible, in this way, to clean the rotor groove at a first opening angle in a first cleaning step and subsequently align the cleaning bore of the cover element with the edge of the spinning rotor and clean it, at a second opening angle.

According to another embodiment, the cleaning measure is carried out with the aid of a cleaning device situated in a movable maintenance unit which is advanced toward the spinning rotor. For this purpose, the open-end spinning machine comprises at least one movable maintenance unit, in which the cleaning device is situated.

Preferably, the cleaning device is initially advanced toward the spinning rotor to be cleaned and, subsequently, the spinning rotor is accelerated to a defined cleaning speed with the aid of a spinning device-specific single drive. Once the cleaning speed has been reached, or thereafter, a cleaning element of the cleaning device is brought into action on the spinning rotor. In the case of the open-end spinning machine, the cleaning element is advantageously designed as a scraper for this purpose. The method is advantageous independently of an adaptation of the settings of the cleaning measure to presently given parameters and has independently inventive significance.

The defined cleaning speed is preferably less than the operating speed of the spinning rotor and is preferably less than 20,000 1/min, more preferably less than 10,000 1/min, and particularly preferably less than 1000 1/min. Due to the single drive of the spinning rotor, it is possible to predefine a separate rotational speed as the cleaning speed in each case depending on various parameters, for example, the rotor diameter, the presently spun yarn, the presently produced yarn count, and the like.

Preferably, the single drive is shut down once the cleaning speed has been reached. Therefore, as soon as the rotor has reached the cleaning speed, the at least one cleaning element is brought into action on the spinning rotor and the kinetic energy of the still-spinning spinning rotor is utilized for cleaning the rotor. In this way, the method can be carried out in a particularly energy-saving manner.

In order to clean tenacious waste, it is also advantageous, however, after the spinning rotor has run down, to accelerate the spinning rotor back up to the cleaning speed and to bring the cleaning element into action on the spinning rotor again. The cleaning measure is therefore repeated, whereby the cleaning result can be improved. This is advantageous, in particular, in connection with the method mentioned at the outset, in which settings for carrying out the cleaning measure are determined depending on parameters.

According to yet another advantageous embodiment, the spinning rotor is driven in a reversing manner by the single drive during the cleaning measure, or the direction of rotation of the single drive is reversed when an anew acceleration up to the cleaning speed is carried out. The cleaning result can also be further improved in this way.

In order to ensure that the spinning rotor rotates centrally during the cleaning and does not undergo a radial deflection, it is also advantageous with respect to the open-end spinning machine when the cleaning device comprises a cleaning head including at least three scraper elements.

The acceleration of the spinning rotor to the cleaning speed followed by a shutdown of the drive is possible in connection with a cleaning device comprising one or multiple scraper elements as well as comprising one or multiple cleaning bores.

In the case of the method, it is also advantageous when the cleaning is carried out, during the pneumatic cleaning using a cleaning bore, using a pulsed stream of compressed air.

BRIEF DESCRIPTION OF THE DRAWINGS

Further advantages of the invention are described with reference to the exemplary embodiments represented in the following. Wherein.

DETAILED DESCRIPTION

Figure 1:
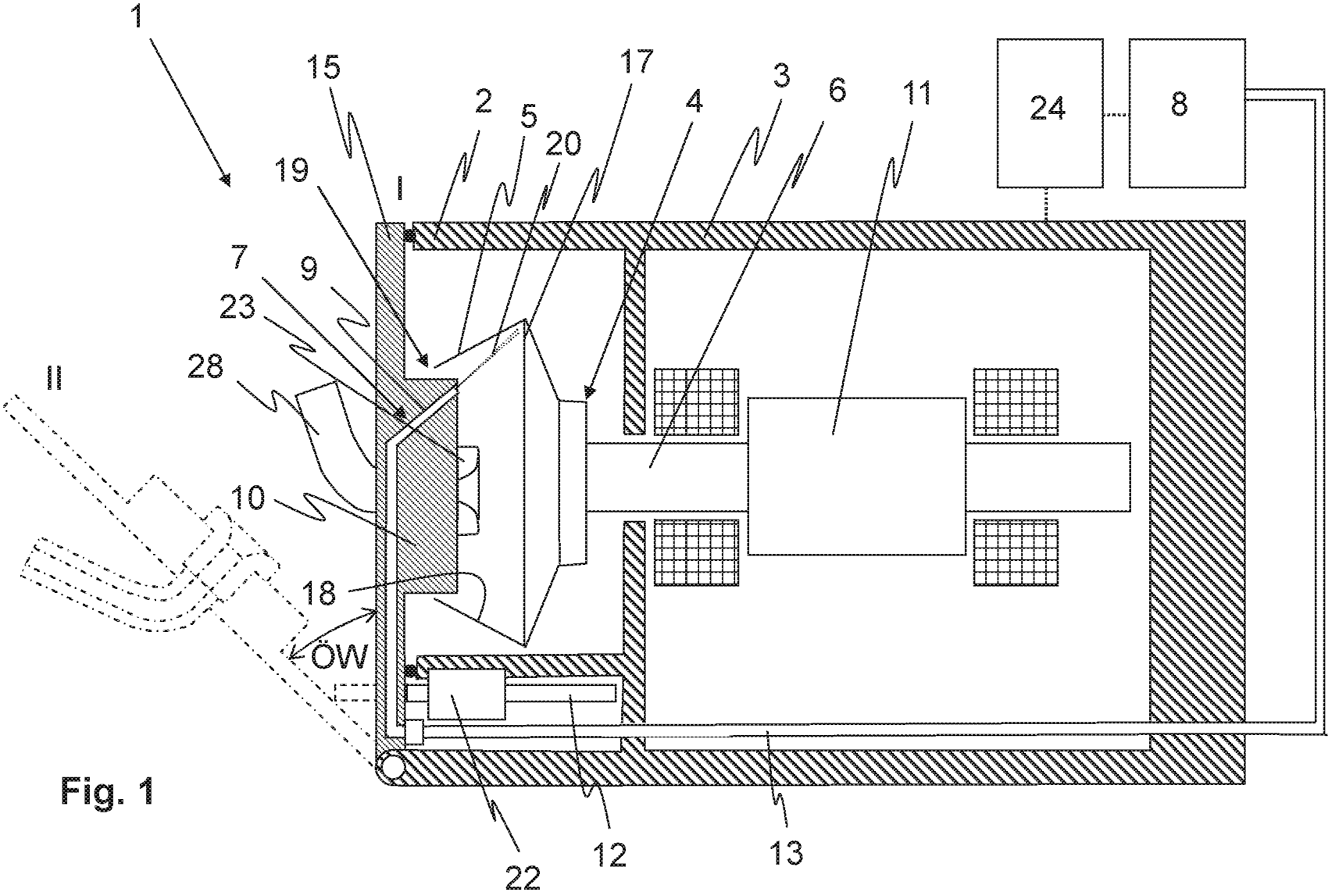
FIG. 1 shows a schematic sectional representation of spinning device of an open-end spinning machine comprising a pneumatic, spinning device-specific cleaning device.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

In the following descriptions of the exemplary embodiments, the same reference signs are utilized for features which are identical or comparable to the various figures in terms of their configuration or mode of operation. These features are therefore explained only when first mentioned, and they are not explained again separately with reference to the subsequent figures. Rather, only the differences from the exemplary embodiments which have already been described are addressed in the subsequent figures.

FIG. 1 shows a schematic sectional representation of a spinning device of an open-end spinning machine (not shown), which comprises, in the usual way, a spinning rotor 4 which is situated in a rotor housing 2 and includes a rotor plate 5 and a rotor shaft 6. Apparent as well are the rotor groove 17 of the spinning rotor, which is particularly affected by waste, the fiber slip wall 18, the edge 19, and the rotor base 21 of the spinning rotor, which also require cleaning at least from time to time. In the present case, the spinning rotor 4 is driven with the aid of a single drive 11 which is situated in a drive housing 3 and is mounted therein. In deviation from the representation shown, the drive with the aid of a single drive 11 is not absolutely necessary, however. In particular in connection with a cleaning device 7 which is situated in a movable maintenance unit, it would also be conceivable to provide a central drive for multiple spinning rotors 4 with the aid of a tangential belt. The method for rotor cleaning described in the following and the open-end spinning machine are independent of the type of drive of the spinning rotor 4. The rotor housing 2 is closed during operation with the aid of a cover element 15 in a manner which is also known. In the present case, the cover element 15 is pivotably fastened on the rotor housing 2 and is shown in its closed position I. From this closed position I, the cover element 15 can be brought into an open position II which is represented in this case by a dotted line and has an opening angle ÖW. In the open position II, the spinning rotor 4 can be cleaned with the aid a cleaning head 26 (see FIGS. 7*a* and 7*b*) which can be advanced toward the spinning rotor 4. In the open position II, any other maintenance actions can also be carried out on the spinning device. In the present case, moreover, a drive 22 for opening the cover element 15 is provided, which acts upon the cover element via a control element 12. With the aid of the drive 22, the cover element 15 can also be brought into one or multiple intermediate positions III (see FIGS. 5*a* and 6*a*) having a certain opening angle ÖW.

Moreover, the spinning device 1 comprises, in the present case, a spinning device-specific, pneumatic cleaning device 7 including a cleaning bore 9 which is connected to a compressed air source 8. In order to clean the spinning rotor 4, compressed air is fed to the cleaning bore 9 via a supply line 13. A stream of compressed air 20 of the cleaning bore 9 is symbolized by a dotted line in this case. According to the present representation, the cover element 15 comprises a shoulder 10 which, in the closed position I of the cover element 15, protrudes into the interior of the spinning rotor 4 and supports a yarn draw-off nozzle 23 and a yarn take-off tube 28. For the sake of clarity, the cutting line through the cover element 15 is not shown correctly in FIG. 1 nor in any of the subsequent figures. Moreover, assigned to the spinning device 1 is a control unit 24 which is operatively connected to the various units of the spinning device 1, such as the single drive 11, the drive 22, the cleaning device 7, the compressed air source 8, as well as further units (not shown) of the spinning device 1, as symbolized by the dotted lines. With the aid of the single drive 11, the spinning rotor 4 can also be driven in a defined manner during the implementation of the cleaning measure by the cleaning device 7.

Figure 5B:
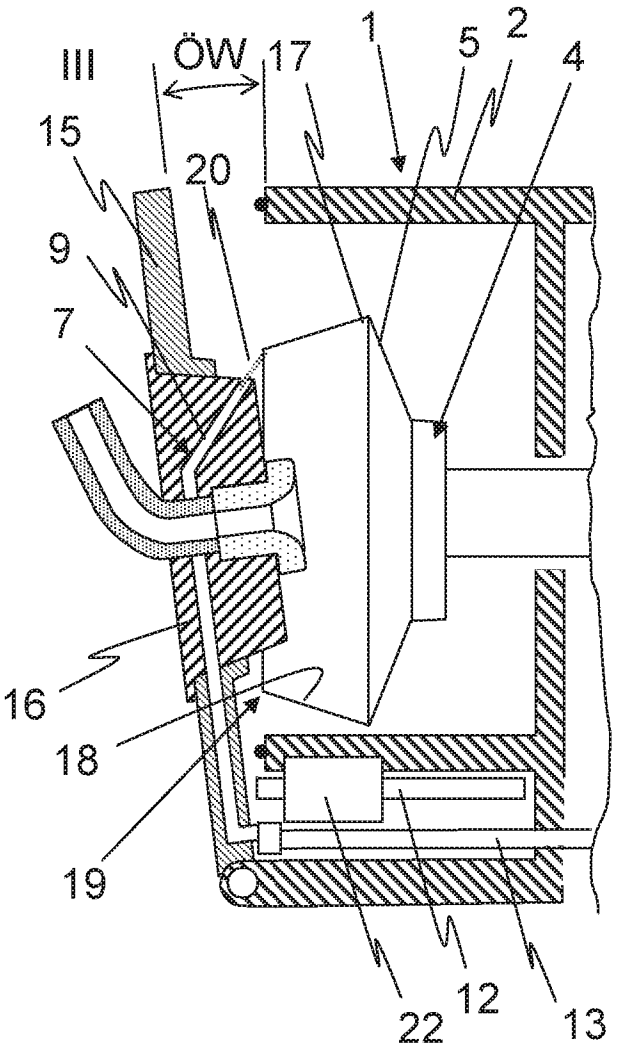
FIGS. 5*a* and 5*b* show a broken, schematic sectional representation of a spinning device comprising a closed (FIG. 5*a*) and a partially opened cover element (FIG. 5*b*)

In deviation from the embodiment of a cover element 15 comprising a shoulder 10 shown in FIG. 1, it is also possible that the cover element 15 comprises an insertable conduit plate adapter 16. This is shown in FIGS. 5 and 6. Such a conduit plate adapter 16 is used for the rapid adaptation of the spinning device 1 with respect to the utilized yarn draw-off nozzle 23 and the utilized yarn take-off tube 28. Preferably, the cleaning bore 9 is provided within this easily exchangeable conduit plate adapter 16.

Figure 5A:
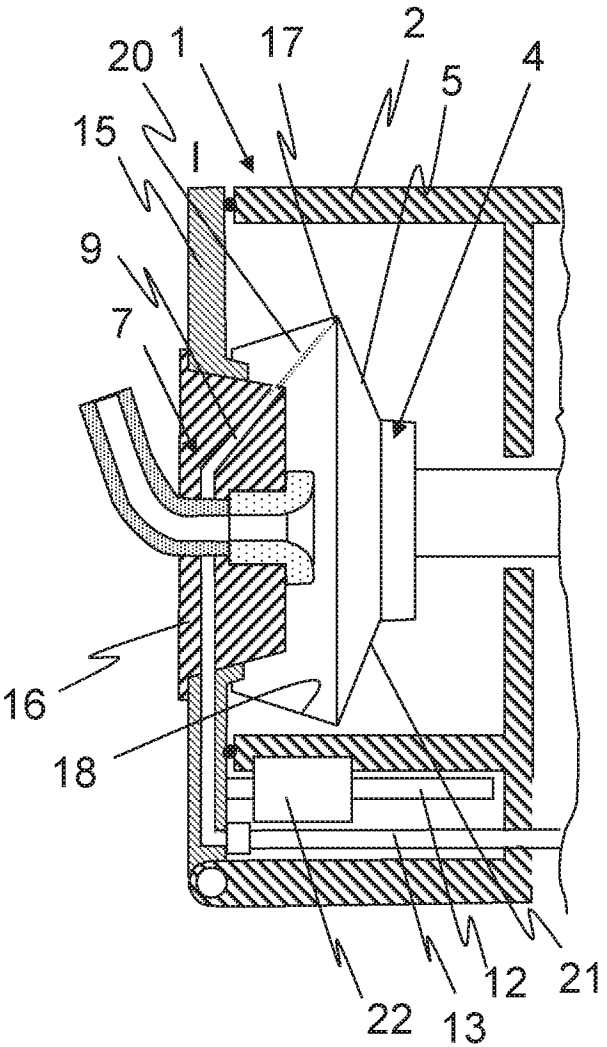
Figure 6B:
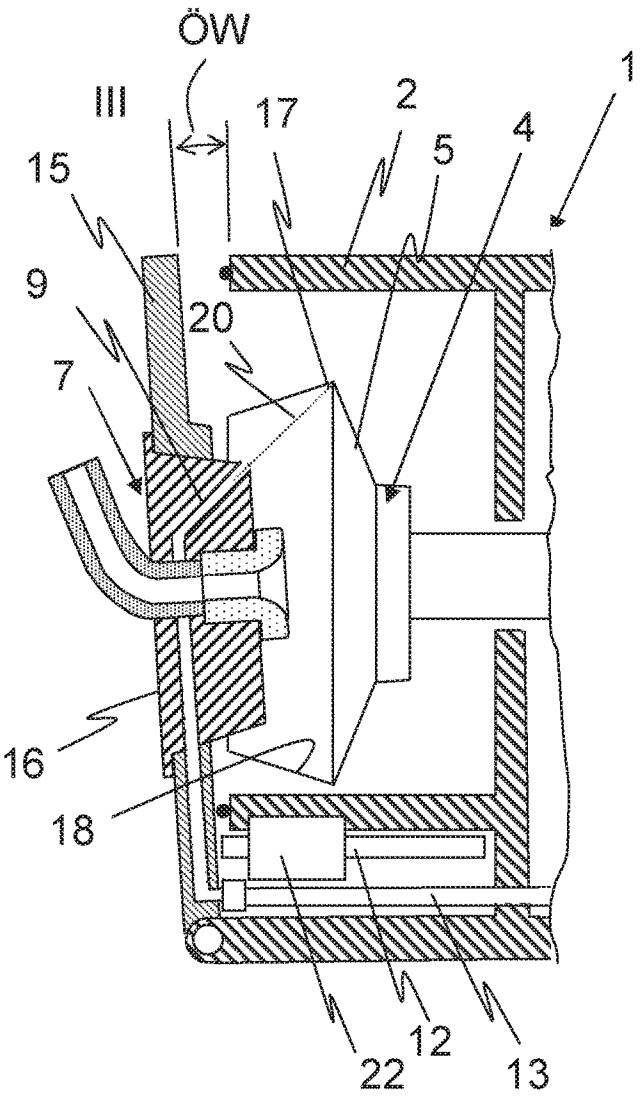
FIGS. 6*a* and 6*b* show yet another sectional representation of an open-end spinning device comprising a closed (FIG. 6*a*) and a partially opened cover element (FIG. 6*b*)

In FIGS. 1 and 5*a*, the cleaning bore 9 is located within the cover element 15 and the conduit plate adapter 16 in such a way that the cleaning bore 9 is directed directly at the rotor groove 17 when the spinning device 1 is closed. In this case, the cover element 15 would therefore not need to be opened with the aid of the drive 22 in order to clean the rotor groove 17. If another type RT of a spinning rotor 4 is utilized, however, the position of the rotor groove 17 can deviate with respect to the cleaning bore 9, and so the cleaning bore 9 is now no longer directed directly at the rotor groove 17, but rather at the rotor base 21, for example. This is the case, for example, with the spinning device 1 from FIG. 6*a*.

Figure 6A:
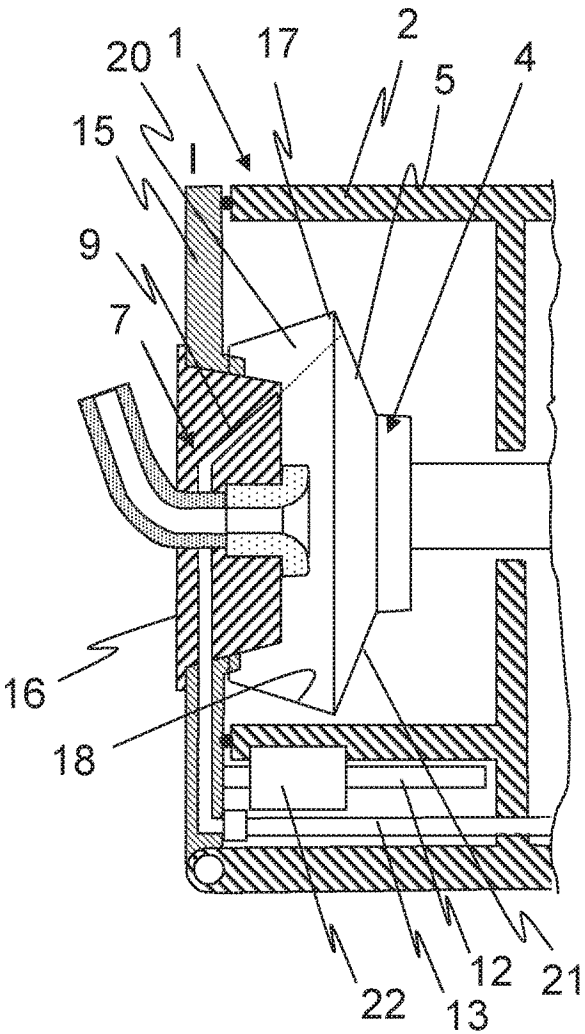

As is apparent in FIG. 6*a*, the opening of the cleaning bore 9 is directed toward the rotor base 21 when the cover element 15 is closed. In order to nevertheless be able to clean the rotor groove 17, the cover element 15 can therefore be opened by a certain opening angle ÖW into an intermediate position III with the aid of the drive 22. If the cover element 15 is located in this intermediate position III, the stream of compressed air 20 and the cleaning bore 9 are now aligned exactly with the rotor groove 17 again. In this case, the opening angle ÖW is predefined by the control unit 24 depending on the type RT (see FIG. 2) of utilized spinning rotor 4 and, if necessary, also by the type KPA (see FIG. 2) of utilized conduit plate adapter 16. Therefore, a reliable cleaning of the rotor groove 17 can take place using the same cleaning bore 9 even with various types RT of spinning rotors 4.

Alternatively or in addition to the cleaning of the rotor groove 17, a cleaning of the fiber slip wall 18 and/or the edge 19 of the spinning rotor 4 can be provided, for the purpose of which an associated opening angle ÖW for cleaning can be set, similarly to the above-described method for various rotor types RT and/or for various types KPA of the conduit plate adapter 16.

This is represented in FIGS. 5*a* and 5*b*. In this case, according to FIG. 5*a*, when the cover element 15 is located in the closed position I, the cleaning bore 9 is directed at the rotor groove 17. If the cover element 15 is opened by the predefined opening angle ÖW and is brought into a certain intermediate position III, the stream of compressed air 20 is directed against the edge 19 of the spinning rotor. Similarly to the example described with reference to FIG. 6, it would therefore also be conceivable to assign to each rotor type RT a certain opening angle ÖW, with the aid of which the edge 19 of the spinning rotor 4 can be cleaned. In addition, yet another opening angle ÖW could be provided, with the aid of which the fiber slip wall 18 can be cleaned.

Figure 7A:
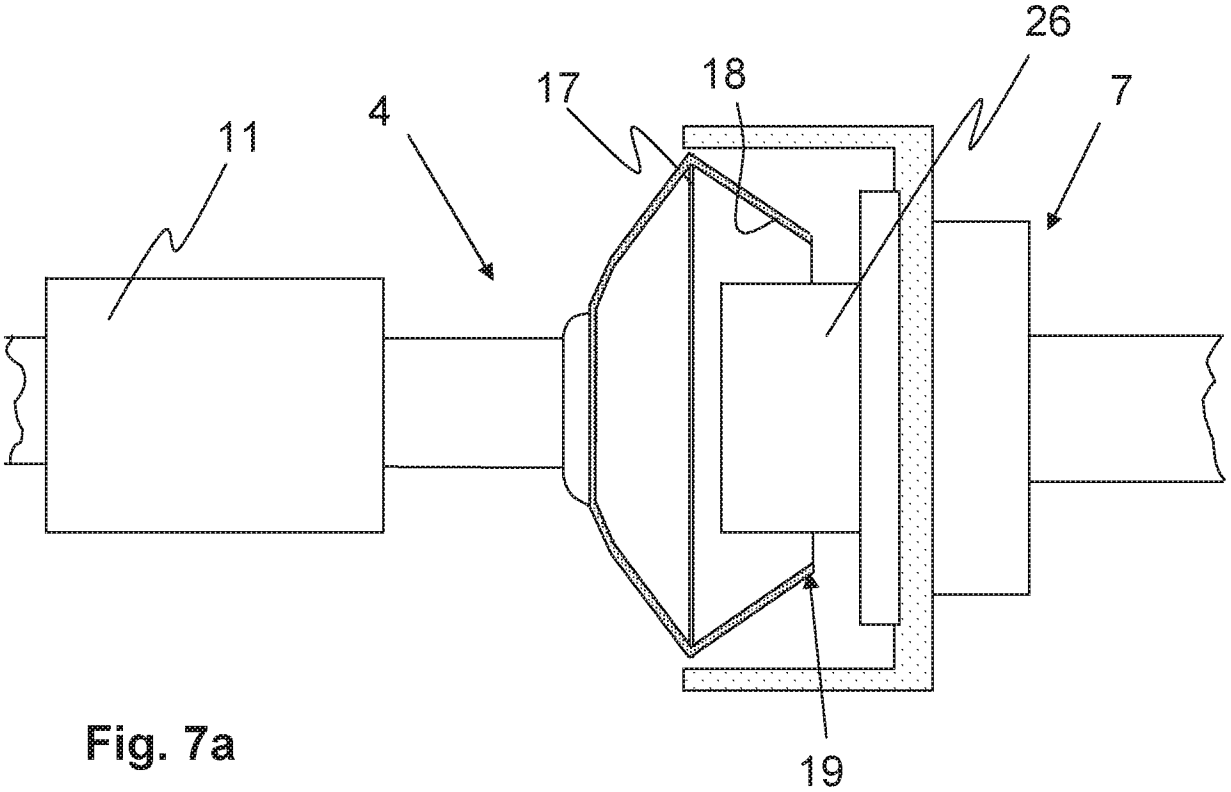
FIG. 7*a* shows a cleaning device of a movable maintenance unit comprising a cleaning head.
Figure 7B:
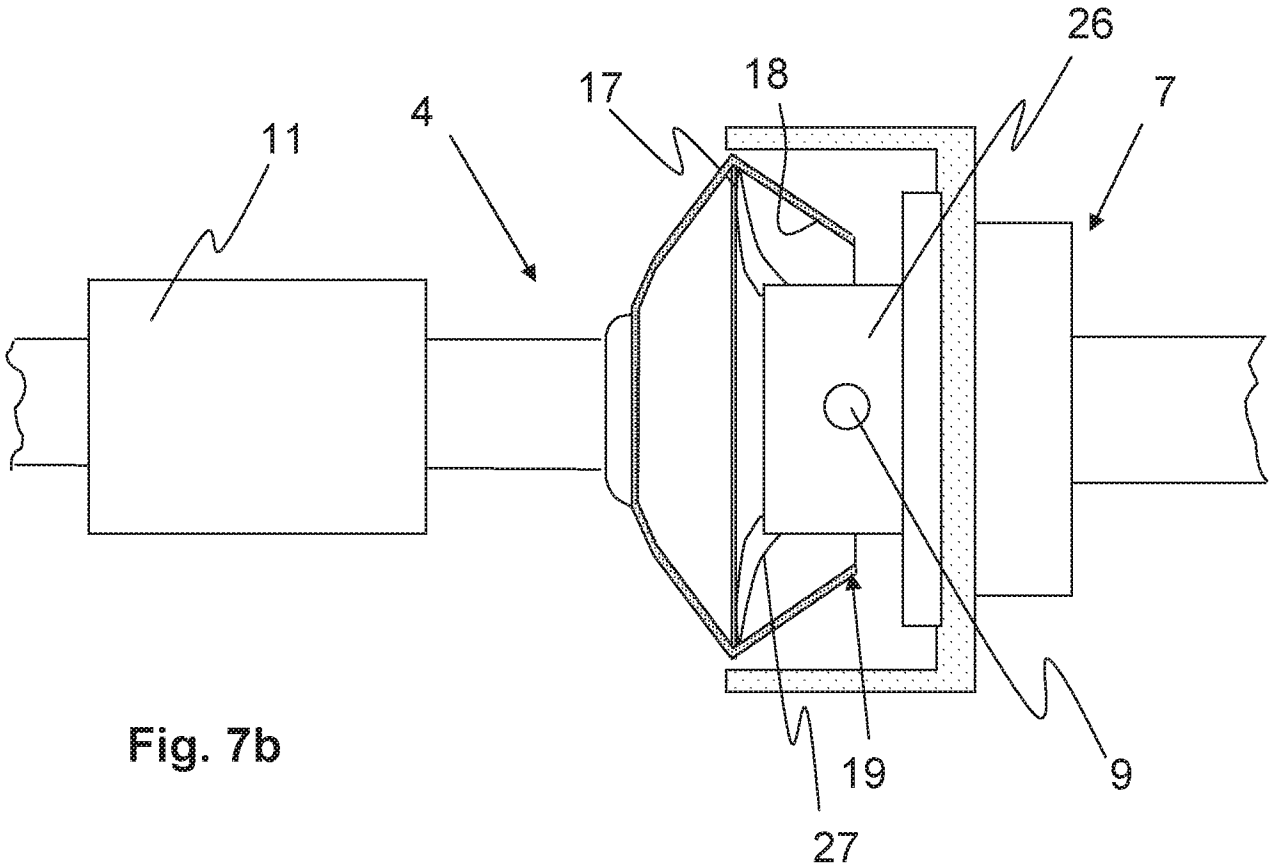
FIG. 7*b* shows the cleaning device from FIG. 7*a*, wherein the cleaning element is brought into action on the spinning rotor.

The method described in the following can be utilized not only in connection with a pneumatic cleaning device 7 and also not only in connection with a spinning device-specific cleaning device 7. The cleaning device 7 could also be situated within a movable maintenance unit (not shown) and could comprise a cleaning head 26 which can be advanced toward the spinning rotor 4, as represented in FIGS. 7*a* and 7*b*. FIG. 7*a* shows the cleaning head 26 in a position in which it has already been advanced toward the spinning rotor 4, but the cleaning elements of the cleaning head 26 are not yet acting on the spinning rotor 4. By comparison, FIG. 7*b* shows the cleaning head 26 in a situation in which the cleaning elements, which are scraper elements 27 in this case, have been brought into action on the spinning rotor 4 to be cleaned, namely into the rotor groove 17 of the spinning rotor 4 in this case. Preferably, the cleaning head includes at least three scraper elements 27, and so these scraper elements 27 act uniformly on the circumference of the spinning rotor 4 and undesirable deflections of the spinning rotor 4 do not occur during the cleaning. In addition, as represented here, the cleaning head 26 can include at least one cleaning bore 9 in addition or as an alternative to the scraper elements.

Now that the spinning device 1 as well as the cleaning devices 7 have been represented in various embodiments, the method for cleaning a spinning rotor 4 will now be explained with reference to FIGS. 2 to 4.

In the case of conventional open-end spinning machines, the rotor cleaning has been carried out using fixedly predefined settings with respect to the cleaning measure. This means, settings such as the duration of the cleaning, a rotational speed of the spinning rotor 4 during the cleaning, and the like were fixedly predefined during the start-up of the open-end spinning machine or at the beginning of a lot, and the cleaning was then always carried out using the same settings. In order to adapt these settings after a lot change or after the insertion of a different spinning rotor 4 or a different conduit plate adapter 16, an operator entered new settings into the control unit 24 based on his/her experience. The settings then often had to be corrected several times over the course of the further operation.

By comparison, a memory bank 25 (see FIGS. 2 to 4) is now provided, which is operatively connected to the control unit 24 and in which various parameters P are stored. Moreover, various settings E are stored in the memory bank 25, each of which is suitable for a certain value of the stored parameters P and which were empirically determined in advance. The control unit 24 can therefore automatically determine, with the aid of the memory bank 25, the settings E of the cleaning measure RM (see FIG. 3) which are suitable for a parameter P which is presently given on the spinning device 1.

Figure 2:
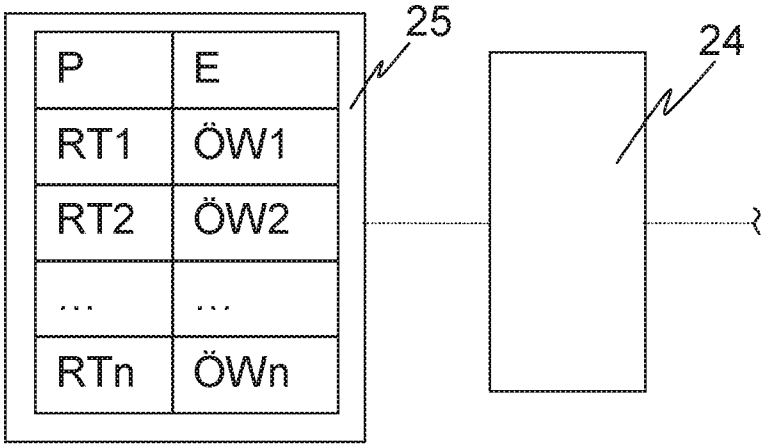
FIG. 2 shows a schematic representation of a method for determining settings for carrying out a cleaning measure according to a first embodiment.
Figure 3:
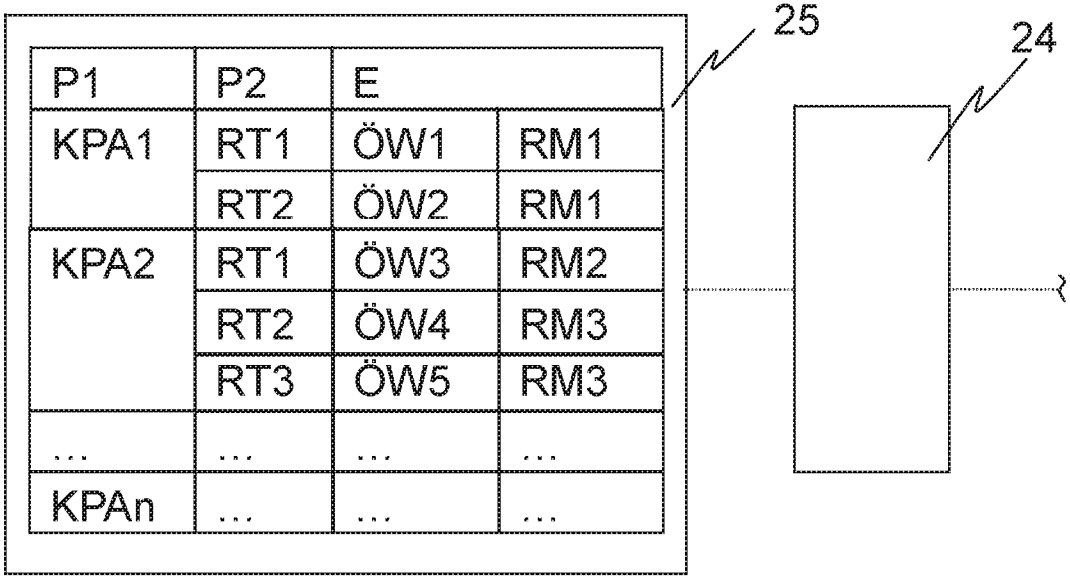
FIG. 3 shows a schematic representation of a method for determining settings for carrying out a cleaning measure according to a second embodiment.
Figure 4:
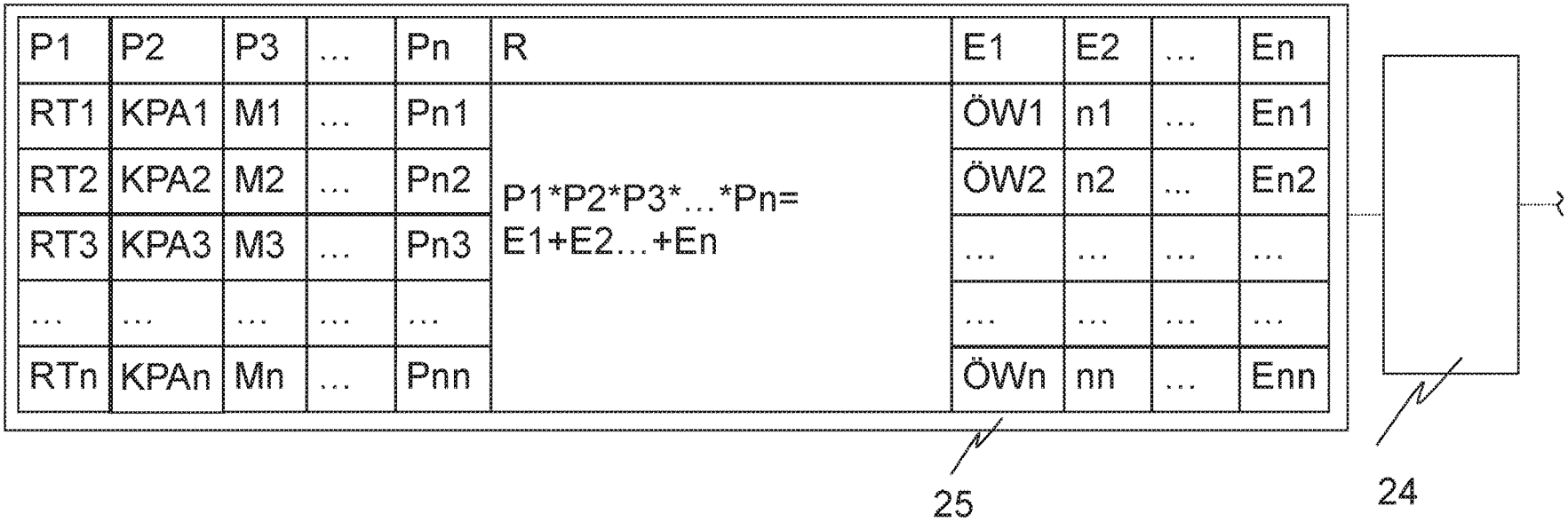
FIG. 4 shows a schematic representation of a further, alternative method for determining settings for carrying out a cleaning measure.

According to the embodiment in FIGS. 2 and 3, the individual parameters P as well as the settings E assigned thereto are all stored in the memory bank 25 in the form of a matrix.

FIG. 2 shows a first, simple embodiment of the method, by way of example. In this case, various rotor types RT1, RT2 to RTn are stored as parameters P in the memory bank 25. Suitable settings E for carrying out the cleaning measure have been determined for each of these various rotor types RT on the basis of trials and previous experience and have been assigned to the individual rotor types RT. In the present case, a suitable opening angle ÖW1, ÖW2 to ÖWn of the cover element 15, at which the cleaning bore 9 is correctly aligned in relation to the rotor groove 17 of this spinning rotor 4, has been determined for each rotor type RT. Therefore, pairs consisting of one rotor type RT and an associated opening angle ÖW are stored in the memory bank 25. For example, assigned to the rotor type RT1 is the opening angle ÖW1, while assigned to the rotor type RT2 is the opening angle ÖW2. The control unit 24 now queries which rotor type RT is presently utilized in the spinning device 1, selects the associated opening angle ÖW from the memory bank 25, and specifies this opening angle ÖW to the drive 22 as the target point variable for the rotor cleaning. It would also be possible, however, for an operator to inform the control unit 24 about the utilized rotor type RT.

In extension of the method, it would also be possible, of course, to assign two or more different opening angles ÖW to each rotor type RT, wherein a first opening angle ÖW is provided for cleaning the rotor groove 17, a second opening angle ÖW is provided for cleaning the edge 19, and, if necessary, yet another opening angle ÖW is provided for cleaning the fiber slip wall 18. It is also understood that the provision of various opening angles ÖW as settings E is to be understood merely as an example. Different durations or different rotor speeds and the like could also be provided as settings E for various rotor types RT.

If an exchangeable conduit plate adapter 16 is utilized in the spinning device 1, it is understood that the settings E described above with reference to FIG. 2 can apply only for a certain conduit plate adapter 16.

FIG. 3 therefore describes an expanded method, in which the type KPA of the utilized conduit plate adapter 16 is additionally taken into account. In the matrix in FIG. 3, assigned to a first type KPA1 of a conduit plate adapter 16 are various rotor types RT1 and RT2, which are compatible with this type KPA1. Assigned to each of these pairs, in turn, is an opening angle ÖW suitable for the type KPA of the conduit plate adapter 16 as well as to the type RT of the spinning rotor 4. The rotor types R1, RT2, RT3 compatible with this conduit plate adapter 16 as well as associated opening angles ÖW3, ÖW4 and ÖW5 are also stored for a second type KPA2 of the conduit plate adapter 16. Similarly to FIG. 2, for example, the control unit 24 initially determines the type KPA of the utilized conduit plate adapter 16 as well as the rotor type RT of the utilized spinning rotor 4 and determines, on the basis thereof, the associated opening angle ÖW. It would also be possible in this case, of course, to provide multiple opening angles ÖW as settings E for cleaning various areas of the spinning rotor 4.

Moreover, even further settings E for the implementation of the cleaning measure can be specified, of course. In the present case, the implementation of certain cleaning measures RM is specified, for example, as a further setting E depending on the rotor type RT and the type KPA of the conduit plate adapter 16. For example, the cleaning measure RM1 is assigned to the combination of the conduit plate adapter 16 of the type KPA1 with the spinning rotor 4 of the type RT1 and of the type RT2. By comparison, the cleaning measure RM3 is provided for the conduit plate adapter 16 of the type KPA 2 in combination with the rotor type RT2. It is possible to provide, as various cleaning measures, for example, a one-time cleaning at a constant speed and direction of rotation of the spinning rotor, a single or multiple repetition of a certain cleaning measure, the reversal of the spinning rotor 4 during the cleaning, cleaning during the opening or during the closing of the cover element 15 or even during the opening of the cover element 15 for suction for waste removal. The cleaning during opening or during closing allows for an additional cleaning of the fiber slip wall 18 in a simple way.

Of course, it would also be possible in the case of the methods represented in FIGS. 2 and 3 to store, alternatively or in addition to the type RT of the spinning rotor 4, further parameters P, for example, the material type M (see FIG. 4) in the memory bank 25 and to query these parameters with the aid of the control unit 24. Other or additional settings E could also be stored in the matrix in the memory bank 25. In this way, for example, in the case of materials such as polyester, the cleaning measure RM can be carried out for a longer duration, or certain cleaning measures RM can be stored as settings E for certain material types M as parameters P.

In extension of the method, it can therefore also be advantageous, as is now explained with reference to FIG. 4, to store a plurality of various parameters P with the various values which the parameters P can assume, as well as rules R for the determination of settings E suitable for these parameters P. The control unit 24 then calculates, with reference to the presently given parameters P, multiple settings E for carrying out the cleaning measure. For example, various rotor types RT1 to RTn are stored as parameters P1 in the present case. In addition, various types KPA1 to KPAn of conduit plate adapters 16 are stored in the memory bank 25 as parameters P2 and various material types M1 to Mn are stored in the memory bank 25 as parameters P3. In addition, one or multiple rules R are stored in the memory bank 25, according to which suitable settings E are determined for the particular parameters P. The rules R are based on empirical determinations and can include rules, for example, for linking the individual parameters, rules for weighting individual parameters, calculation formulas for calculating the settings E from the parameters P, or even decision structures such as tree diagrams and the like. In the present case, an arbitrary link (asterisk) of the parameters P1 to Pn is described as rule R merely in a general form, with the aid of which the control unit 24 determines a sum of various settings E1 to En. The various settings E can include, for example, as setting E1, the opening angle ÖW of the cover element 15 and, as the setting E2, a certain rotor speed n of the spinning rotor 4 as the cleaning speed. These settings E can also assume various values, of course, as is symbolized by the numbering ÖW1 to ÖWn and n1 to nn, and are preferably automatically set on the spinning device 1 by the control unit 24.

Even further settings E, such as the duration of the cleaning or the direction of rotation of the spinning rotor 4 during the cleaning, can also be provided, of course. It is understood that numerous parameters P as well as settings E are possible. In this case, cleaning parameters of the cleaning measure, which were represented here as settings E, can also be stored as parameters P, of course, in the memory bank 25. The rotor speed n is indicated as the determined setting E in this case, for example. This could also be specified as a parameter by an operator, however, or, similarly to that described with reference to FIGS. 2 and 3, could be already fixedly linked to certain other parameters P. The same applies, of course, for a duration of the cleaning, which can be calculated as setting E and can be specified as parameter P. In this way, for example, a shorter cleaning time can be specified during a maintenance action carried out by a movable maintenance device which is provided for a plurality of spinning devices 1, in order to shorten the downtimes of the spinning devices 1. Moreover, it is also conceivable, of course, to store various programs for carrying out the cleaning measure RM as settings E which are assigned to the various parameters P in the form of a matrix.

The invention can be utilized particularly well on so-called autonomous spinning units which can carry out the piecing operation completely independently without the use of an operator or a movable maintenance device. It is also possible, however, to advantageously utilize the method in connection with a movable maintenance device. In any case, due to the parameters stored in the memory bank and the settings or calculation formulas assigned to these parameters for determining the settings, it is possible to always achieve good and reproducible cleaning results even under various presently given conditions at the spinning units. In addition, when the machine is loaded with multiple lots, it is possible to take different conditions at individual spinning devices into account by way of different settings of the cleaning measure. As a result, the piecing quality and piecing strength can be substantially improved and the piecing efficiency and the yarn quality can be enhanced.

The invention is not limited to the exemplary embodiments which have been represented. Modifications and combinations within the scope of the claims are also covered by the invention.

LIST OF REFERENCE SKINS

1 spinning device
2 rotor housing
3 drive housing
4 spinning rotor
5 rotor plate
6 rotor shaft
7 cleaning device
8 compressed air source
9 cleaning bore
10 shoulder
11 single drive
12 control element
13 supply line
15 cover element
16 conduit plate adapter
17 rotor groove
18 fiber slip wall
19 edge of the spinning rotor
20 stream of compressed air
21 rotor base
22 drive
23 yarn draw-off nozzle
24 control unit
25 memory bank
26 cleaning head
27 scraper element
28 yarn take-off tube I closed position of the cover element
II open position of the cover element
III intermediate position
ÖW opening angle
RT rotor type
KPA type of the conduit plate adapter
P parameter
E setting
RM cleaning measure
M material type
n cleaning speed of the spinning rotor

The invention claimed is:

1. A method for cleaning a spinning rotor of a spinning device in an open-end spinning machine in which at least one cleaning measure is carried out on the spinning rotor with the aid of a pneumatic or a mechanical cleaning device, comprising:

storing parameters in a memory bank, wherein settings for carrying out the cleaning measure are automatically determined by a control unit associated with the open-end spinning machine based on present parameters of the spinning device;

with a control unit associated with the open-end spinning machine and the memory bank, specifying settings for carrying out the cleaning measure by one or both of:

previously empirically determined settings for carrying out the cleaning measure suitable for the present parameters of the spinning device stored in the memory bank; or rules for determining the settings suitable for the present parameters the spinning device stored in the memory bank;

wherein a cover element of the spinning device is at least partially opened in order to carry out the cleaning measure; and wherein the settings include an opening angle of the cover element that is changeable and determined based on one or both of the parameters of type of the spinning rotor or type of a channel insert adapter used with the spinning rotor and rotor.

2. The method as in claim 1, wherein the parameters further comprise any one or combination of the following parameters of the spinning device: type of material being processed at the spinning device, and yarn count.

3. The method as in claim 1, wherein the settings for carrying out the cleaning measure further comprise any one or combination of: duration of the cleaning measure; speed of the spinning rotor for the cleaning measure; direction of rotation of the spinning rotor for the cleaning measure; number of repetitions of the cleaning measure; reversing of the spinning rotor for the cleaning measure; and type of the cleaning measure.

4. The method as in claim 1, wherein the parameters further include any one or combination of the following setting parameters for the cleaning measure: duration of cleaning of the spinning rotor; direction of rotation of the spinning rotor; number of repetitions of the cleaning measure; a reversing of the spinning rotor; and type of the cleaning measure.

5. The method as in claim 1, wherein the cleaning measure is carried out with a cleaning device that is situated in a movable maintenance unit and is initially advanced toward the spinning rotor to be cleaned and, subsequently, the spinning rotor is accelerated to a defined cleaning speed with a drive and, once the cleaning speed has been reached, or thereafter, a cleaning element of the cleaning device is brought into action on the spinning rotor and the spinning rotor is cleaned.

6. The method as in claim 5, wherein the defined cleaning speed is less than an operating speed of the spinning rotor.

7. A method for cleaning a spinning rotor of a spinning device in an open-end spinning machine in which at least one cleaning measure is carried out on the spinning rotor with the aid of a pneumatic or a mechanical cleaning device, comprising:

storing parameters in a memory bank, wherein settings for carrying out the cleaning measure are automatically determined by a control unit associated with the open-end spinning machine based on present parameters of the spinning device;

with a control unit associated with the open-end spinning machine and the memory bank, specifying settings for carrying out the cleaning measure by one or both of:

previously empirically determined settings for carrying out the cleaning measure suitable for the present parameters of the spinning device stored in the memory bank; or rules for determining the settings suitable for the present parameters of the spinning device stored in the memory bank;

wherein a cover element of the spinning device is at least partially opened in order to carry out the cleaning measure;

wherein the parameters comprise at least type of a channel insert adapter or type of the spinning rotor, and the settings include at least an opening angle of the cover element of the spinning element; and wherein the cleaning measure comprises multiple cleaning steps and assigned to each of the cleaning steps is a separate opening angle of the cover element.

8. A method for cleaning a spinning rotor of a spinning device in an open-end spinning machine in which at least one cleaning measure is carried out on the spinning rotor with the aid of a pneumatic or a mechanical cleaning device, comprising:

storing parameters in a memory bank, wherein settings for carrying out the cleaning measure are automatically determined by a control unit associated with the open-end spinning machine based on present parameters of the spinning device;

with a control unit associated with the open-end spinning machine and the memory bank, specifying settings for carrying out the cleaning measure by one or both of:

previously empirically determined settings for carrying out the cleaning measure suitable for the present parameters of the spinning device stored in the memory bank; or rules for determining the settings suitable for the present parameters of the spinning device stored in the memory bank;

wherein the cleaning measure is carried out with a cleaning device that is situated in a movable maintenance unit and is initially advanced toward the spinning rotor to be cleaned and, subsequently, the spinning rotor is accelerated to a defined cleaning speed with a drive and, once the cleaning speed has been reached, or thereafter, a cleaning element of the cleaning device is brought into action on the spinning rotor and the spinning rotor is cleaned;

wherein the defined cleaning speed is less than an operating speed of the spinning rotor; and wherein the drive is shut down once the cleaning speed has been reached, and subsequent to the spinning rotor running down, the spinning rotor is accelerated back to the cleaning speed again with the drive and the cleaning element is brought into action on the spinning rotor again.

9. The method as in claim 8, wherein the spinning rotor is driven in a reversing manner during the cleaning measure, or a direction of rotation of the single drive is reversed for the subsequent acceleration of the spinning rotor back to the cleaning speed.

10. An open-end spinning machine, comprising:

a spinning device, the spinning device comprising a spinning rotor;

a cleaning device configured to carry out a cleaning measure on the spinning rotor;

a control unit associated with the open-end spinning machine, the control unit configured to:

automatically determine settings for the cleaning measure using stored parameters in a memory bank based on present parameters of the spinning device by one or both of:

previously empirically determined settings for carrying out the cleaning measure suitable for the present parameters of the spinning device stored in the memory band; or rules for determining the settings suitable for the present parameters of the spinning device stored in the memory bank;

a cover element of the spinning device that is at least partially opened in order to carry out the cleaning measure; and wherein the settings include an opening angle of the cover element that is changeable and determined based on one or both of the parameters of type of the spinning rotor or type of a channel insert adapter used with the spinning rotor and rotor.

11. The open-end spinning machine as in claim 10, the spinning device comprises a drive for driving the spinning rotor and a separate drive for opening the cover element of the spinning device.

12. The open-end spinning machine as in claim 10, wherein the cleaning device comprises a pneumatic cleaning device.

13. The open-end spinning machine as in claim 10, further comprising a movable maintenance unit, the cleaning device configured in the movable maintenance unit.

* * * * *